United States Patent [19]

Hannay

[11] Patent Number: 4,578,900

[45] Date of Patent: Apr. 1, 1986

[54] VENTILATION APPARATUS

[75] Inventor: Gregory J. F. Hannay, Brisbane, Australia

[73] Assignee: Crestlite Aluminum Pty. Ltd., Geebung, Australia

[21] Appl. No.: 672,247

[22] PCT Filed: Feb. 28, 1984

[86] PCT No.: PCT/AU84/00029

§ 371 Date: Oct. 30, 1984

§ 102(e) Date: Oct. 30, 1984

[87] PCT Pub. No.: WO84/03534

PCT Pub. Date: Sep. 13, 1984

[30] Foreign Application Priority Data

Mar. 1, 1983 [AU] Australia ..... PF8248

[51] Int. Cl.[4] ..... E05F 15/20

[52] U.S. Cl. ..... 49/5; 49/1; 49/7

[58] Field of Search ..... 49/1, 5, 6, 7, 8

[56] References Cited

U.S. PATENT DOCUMENTS 709,800 9/1902 Rupp ..... 49/5

778,456 12/1904 Lunken ..... 49/5

842,369 1/1907 Zahner ..... 49/5

2,896,753 7/1959 Knabel ..... 49/1

*Primary Examiner*—Kenneth Downey

*Attorney, Agent, or Firm*—Schmidt, Johnson, Hovey & Williams

[57] ABSTRACT

A double hung window assembly (10) having a perimeter frame assembly (11) and a vertically slidable upper sash (12) secured in its raised or closed position by fusible link means (26) to the frame assembly (11). The vertically slidable bottom sash (13) has releasable catch means (42) for securing it in its lowered or closed position. Stop means (30) adapted to prevent the upper sash (12) moving beyond the lower sash (13) is present. Biasing means (40) are included with the bottom sash (13) to provide an elevated bias to it, sufficient to hold the bottom sash (13) in selected open or raised positions but insufficient to hold both the upper (12) and lower (13) sashes in an elevated position upon release of the fusible link (26) whereby when the assembly (10) is used and the bottom sash (13) is elevated, both sashes will move to their lower positions to provide a smoke ventilating opening thereabove.

11 Claims, 5 Drawing Figures

VENTILATION APPARATUS

This invention relates to smoke ventilation apparatus.

In modern buildings personal injury or death from fire can result from the inhalation of toxic fumes as much as from the heat of the fire itself, particularly since most modern buildings are furnished with synthetic products which give off large quantities of toxic fumes during combustion. As a result it is desirable to provide means for ventilating buildings in a fire situation to ensure that the toxic fumes are exhausted from a burning building to enable the occupants to obtain fresh air in order that they may escape from the burning building.

This has been achieved in the past in some buildings, particularly those not fully air conditioned, by providing window panels which are mounted in a frame such that the panel is hingedly connected at its bottom edge to the frame and is retained in the closed position by a fusible link interconnecting the top edge of the panel to the frame. Spring means are frequently provided to bias the panel to the open position and generally stays are provided to limit the amount of hinging of the panel. These stays are necessary since such panels may be situated adjacent a balcony and a panel which could pivot freely could fall upon and cause injury to a person. For the sake of economy such panels are often in the form of a clear fixed glass panel which is built into a framed modular unit which may incorporate a sliding door and other windows or closure panels.

In such installations it is essential that no other fixing means be provided to secure the panel in the closed position since the panel at all times must be able to open in the case of fire. As a result the glazed panel has to remain in the closed position and thus it cannot be used for ventilation to provide fresh air to the interior of the building. Another disadvantage associated with such smoke ventilation apparatus is that the framing structure for the panel has to be made relatively large to withstand wind loadings imposed by regulation since the frame is supported only at its top and at its bottom leaving the jambs unsupported in the outward direction. The resultant frame is relatively bulky and this can detract from the appearance of the assembly. The resultant bulky construction causes such window installations to be relatively expensive.

It is an object of the present invention to provide smoke ventilation apparatus which will alleviate the disadvangates associated with prior art devices and which will prove reliable and efficient in use. Other objects and advantages of the present invention will hereinafter become apparent.

With the foregoing and other objects in view this invention in one aspect resides broadly in a double hung window assembly including a perimeter frame having a head rail, a vertically slidable upper sash secured in its raised or closed position by fusible link means to the frame assembly; a vertically slidable bottom sash having releasable catch means for securing the bottom sash in its lower or closed position; stop means adapted to prevent the upper sash moving beyond the lower sash, and biasing means for said bottom sash adapted to provide an elevating bias thereto sufficient to hold the bottom sash in selected open or raised positions but insufficient to hold both said upper and lower sashes in an elevated position upon release of said fusible link whereby in use when said bottom sash is elevated, both said sashes will move to their lower position to provide a smoke ventilation opening thereabove.

In order that the present invention may be more readily understood and put into practical effect, reference will now be made to the accompanying drawings which illustrate a preferred embodiment of the invention, wherein.

Figure 1:
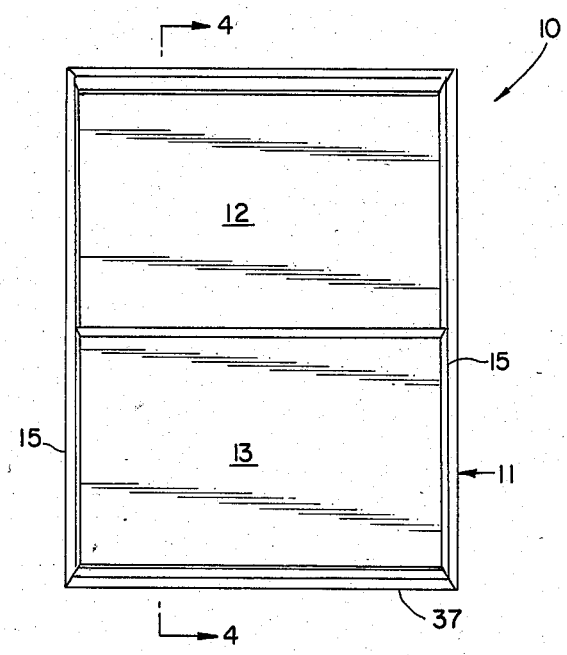
FIG. 1 is a front view of a double hung window assembly of the present invention in the closed position.
Figure 2:
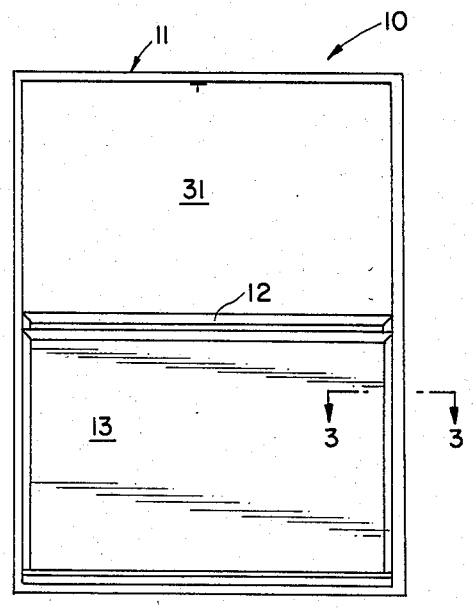
FIG. 2 is a corresponding view of the window assembly in the smoke ventillating position.

As shown, the smoke ventillating window assembly 10 includes a perimeter frame assembly 11 supporting a pair of vertically slidable sashes comprising an upper sash 12 and a lower sash 13. These sashes slide in spaced vertical channel-like tracks 14 formed in side rails 15 of the frame assembly 11. To facilitate ease of sliding, nylon guide inserts 16 are located in the base of the tracks 14 and the sash side frames 17 support bearing-/sealing strips 18.

Figure 4:
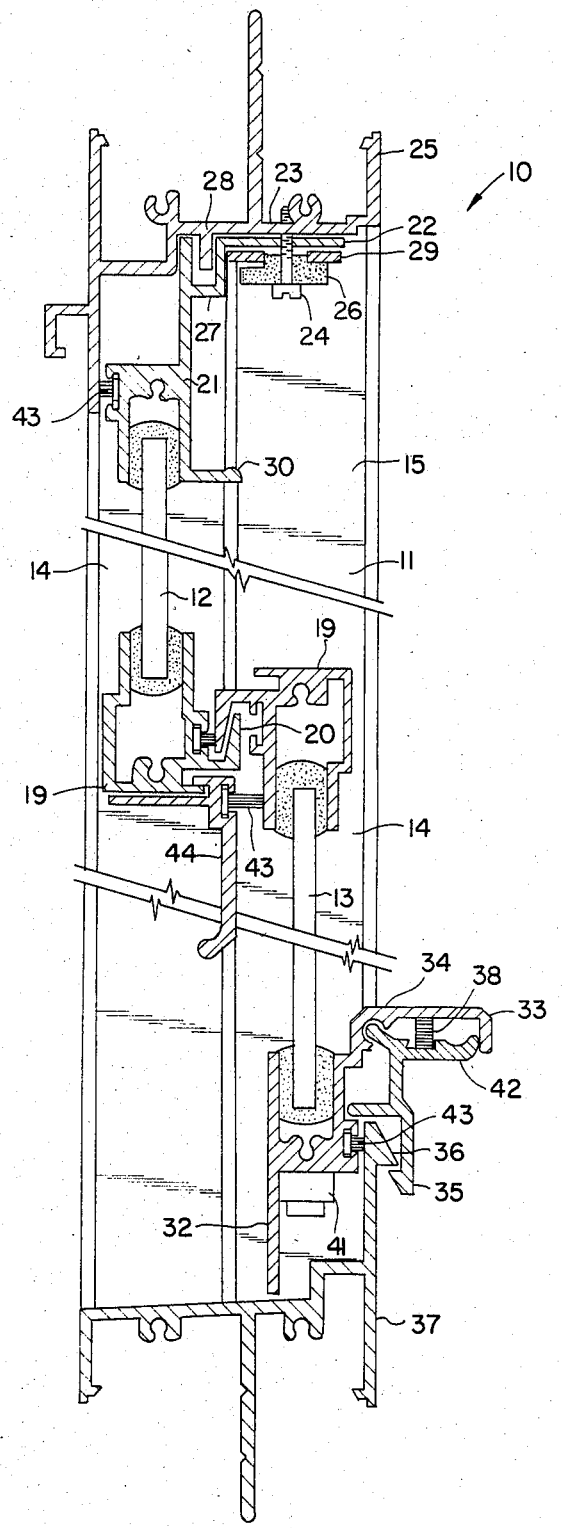
FIG. 4 is a typical cross-sectional view taken along the line 4—4 of FIG. 1; and, FIG. 5 is a fragmentary part sectional view of a modified embodiment of the assembly shown in FIG. 4.

The medial rails 19 of the sash frames are formed from a common extrusion and include tongues 20 which interlock for weather proofing and for operative connection when in the closed position as illustrated in FIG. 4 to increase the effective strength of the window 10. The upper rail 21 of the upper sash 12 includes an inwardly extending flange 22 which is apertured at 23 to permit a screw 24 to pass therethrough into the head rail 25 of the frame assembly 11 whereby a fusible link 26 may be supported beneath the flange 22 to secure the upper sash to the frame assembly 11. If desired a fusible link could be arranged to interconnect the side frame of the sash to the frame 11. This is shown in FIG. 5.

Figure 5:
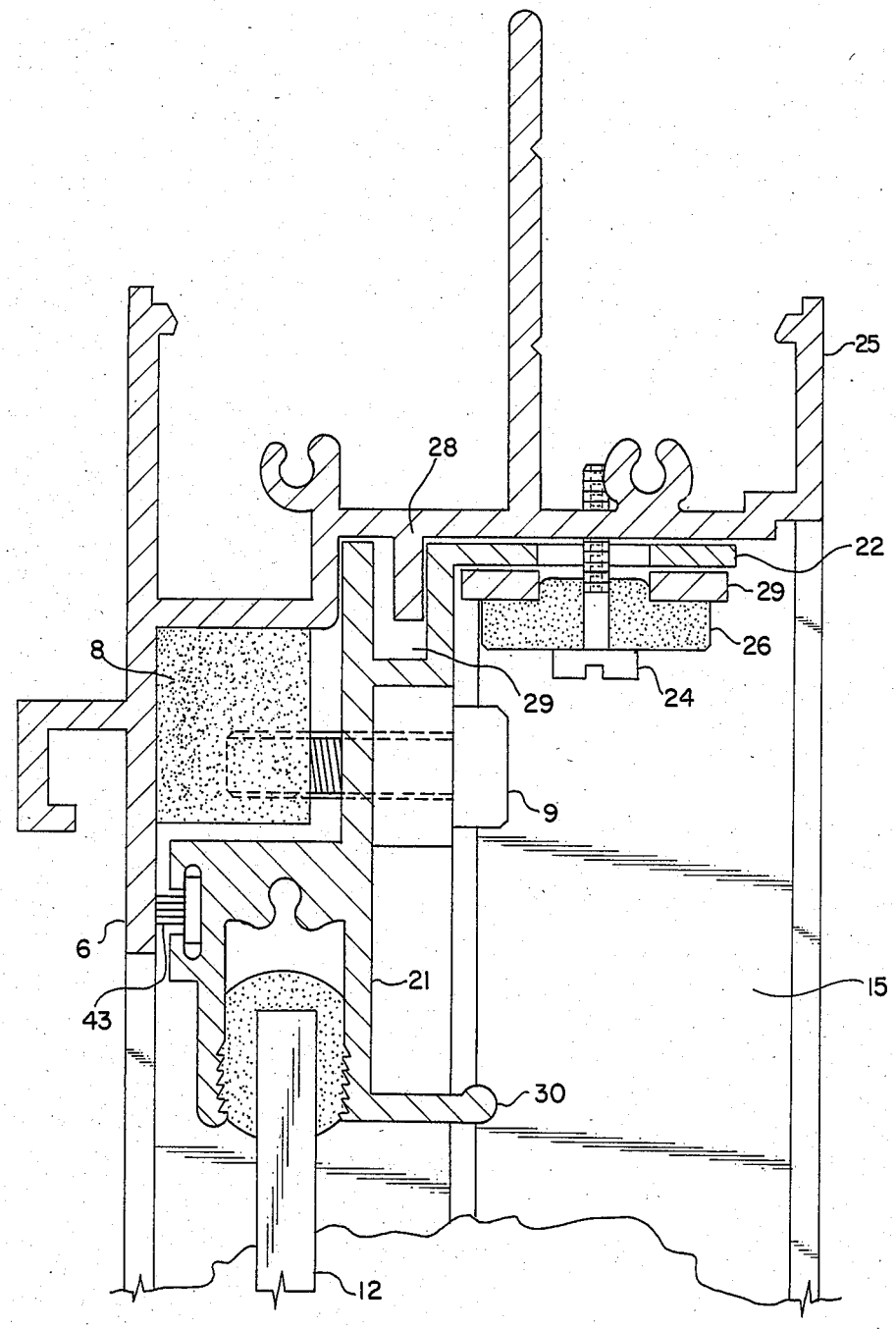

FIG. 5 shows a fragmentary sectional view of an assembly showing an alternative location for the fusible link connection between the upper sash and the perimeter frame assembly. The fusible link may be located as shown in FIG. 4 and thus is shown also in FIG. 5. Instead of fusible link 26 and screw 24, a fusible link 8 and fastener 9 may be used. It should be understood that whichever location is employed the connections between the upper sash and the frame may be severed as a consequence of elevated temperature or by a smoke detector whose output may be used to sever the connection. This may be done by using the smoke detector output to heat a coil (not shown) imbedded in the fusible link.

It will be seen that the upper rail 21 includes a U shaped assembly locating portion 27 which locates about a rib 28 in the head rail 25 of the frame assembly 11 whereby movement of the top sash in the inwards and outwards direction is restricted. The aperture 23 through the flange 22 in the top rail is sufficiently large to allow such movement without preventing the head of the screw 24 passing therethrough. Thus the permitted movement of the top rail will not affect release of the top sash upon fusing of the fusible link 26. It will also be seen that a thermal insulator 29 is interposed between the fusible link 26 and the window frame assembly to ensure that the link 26 does not fuse as a result of temperature rise in the metal frame from incident sunlight.

The rails of the sash frames are formed with channel-shaped grooves to secure glass panes therein in known manner as illustrated. The upper rail 21 further includes an inwardly extending abutment flange 30 which overlies the intermediate rail 19 of the lower sash frame so that when the upper sash is released it will fall and the flange 30 will strike the lower sash 13, and if the latter is raised, carry it to its fully closed position, leaving maximum opening space 31 above the sashes 12 and 13 for smoke ventilation purposes.

Figure 3:
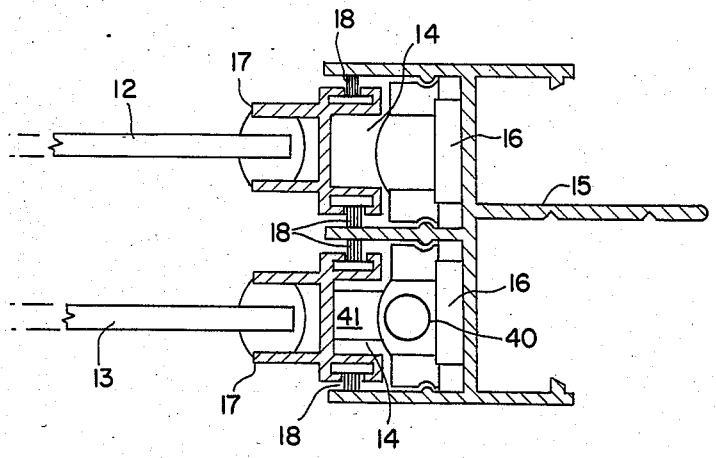
FIG. 3 is a typical cross-sectional view taken along the line 3—3 of FIG. 2.

Suitably the lower rail 32 of lower sash 13 is formed with a full width handle portion 33 provided with a groove 34 along its underside in which a latch member 42 is pivotally located. This latch member includes a ramped latching rib 35 along its under-side which engages with a reversely ramped rib 36 on the lower rail 37 of the frame assembly 11. The latch member 42 is biased by a spring 38 to its engaged position as illustrated in FIG. 3. Grasping of the handle 33 for lifting will automatically pivot the latch member 42 and free the latching rib 35 so that the bottom sash may be raised to permit ventilation. For this purpose there is provided a biasing tension spring 40 located in the track 14 in which the lower sash moves and connects between a shoe 41 attached to the lower rail 32 and a suitable mounting in the frame assembly 11. The lifting effect provided by the spring 40 is sufficient to hold the lower sash 13 in any selected raised position but it is not sufficient to support the combined weight of the upper and lower sashes 12 and 13. Thus in the case of fire, the fusible link 26 will release and the top sash will fall gravatationally until the flange 30 strikes the intermediate rail 19 of the lower sash to leave a smoke ventilating opening 31 thereabove. If the lower sash is raised, the upper sash will fall until it engages the elevated lower sash whereupon the combined weight of the upper and lower sashes will overcome the biasing effect of the spring 40 and will move to their lower positions. Both sashes will then move down to the bottom of the frame assembly 11 leaving a clear open space thereabove substantially equal to the area of the upper sash.

Weather sealing strips 43 may be provided as indicated extending between the frame assembly 11 and the upper rail 21, between medial rails 19, between lower rail 32 and lower rail 37 of the frame assembly 11 and between L shaped frame member 44 and medial rail 19 of the lower sash 13.

Of course any known type of biasing or counterbalancing may be used to hold the lower sash in its elevated position during normal use, such as counterweights or spiral type biasing means. The guide means for the sashes could be internal tracks as illustrated or they could be external rails adapted to co-operate with grooves in the sash frames. Also while in the illustrated window the upper sash is gravationally biased to the lowered position, it could be spring biased if desired. The stop means for preventing the upper sash moving beyond the lower sash could be arranged on the lower rail of the lower sash.

All such modifications and variations to the illustrated embodiment as would be apparent to persons skilled in the art are deemed to fall within the broad scope and ambit of the present invention as is defined in the appended claims.

I claim:

1. A double hung window assembly including:

a perimeter frame assembly having a head rail, a vertically slidable upper sash secured in its raised or closed position by retaining means to the frame assembly;

a vertically slidable bottom sash having releasable catch means for securing the bottom sash in its lower or closed position;

stop means adapted to prevent the upper sash moving beyond the lower sash, and biasing means for said bottom sash adapted to provide an elevating bias thereto sufficient to hold the bottom sash in selected open or raised positions but insufficient to hold both said upper and lower sashes in an elevated position upon release of said retaining means whereby in use when said bottom sash is elevated both said sashes will move to their lower position to provide a smoke ventilation opening thereabove.

2. The double hung window assembly of claim 1, wherein said upper sash includes an upper rail, a lower medial rail and two side frames, said head rail has a downwardly directed rib and said upper rail includes a U shaped locating portion which locates about the rib to restrict inwards and outwards movement of said upper sash.

3. The double hung window assembly of claim 1, wherein said retaining means comprises fusible link means.

4. The double hung window assembly of claim 3, wherein said upper rail includes an apertured flange normally adjacent said head rail and having fixing means extending through said aperture and into said head rail, said fixing means being secured to said apertured flange by said fusible link means.

5. The double hunge window assembly of claim 4, including thermal insulating means transposed adjacent said fixing means and between said head rail and said apertured flange.

6. The double hung window assembly of claim 1, wherein said biasing means is gravity.

7. The double hung window assembly of claim 2, wherein said lower sash includes an upper medial rail and a lower rail.

8. The double hung window assebmly of claim 7, wherein said stop means comprises an abutment flange projecting outwardly from said upper rail and overlying said medial rail of said lower sash when said upper sash is in its lower position.

9. The double hunge window assembly of claim 1, including biasing means extending between the perimeter frame assembly and said lower sash providing sufficient lifting effect to hold said lower sash in any selected raised position but insufficient to support the combined weight of said upper and lower sashes.

10. The double hung window assembly of claim 7, wherein said catch means is formed by a latch member pivotally located within a groove in a handle portion formed integral with said medial rail of said lower sash and a latching rib formed on a lower rail of said perimeter frame assembly.

11. The double hung window assembly of claim 10, including biasing means between said handle portion and said latch member.

* * * * *